United States Patent [19]

Jaster

[11] Patent Number: 4,466,253

[45] Date of Patent: Aug. 21, 1984

[54] FLOW CONTROL AT FLASH TANK OF OPEN CYCLE VAPOR COMPRESSION HEAT PUMPS

[75] Inventor: Heinz Jaster, Schenectady, N.Y.

[73] Assignee: General Electric Company, Schenectady, N.Y.

[21] Appl. No.: 452,643

[22] Filed: Dec. 23, 1982

[51] Int. Cl.[3] ..... F25D 17/02

[52] U.S. Cl. ..... 62/188; 60/686; 62/49; 62/512

[58] Field of Search ..... 62/512, 49, 188; 60/686

[56] References Cited

U.S. PATENT DOCUMENTS 3,159,008 12/1964 Nebgen ..... 62/512
3,212,277 10/1965 Harper et al. ..... 62/512
3,383,881 5/1968 Bailey ..... 62/49
3,957,111 5/1976 Kobayashi et al. ..... 62/512

*Primary Examiner*—Ronald C. Capossela
*Attorney, Agent, or Firm*—Paul J. Checkovich; James C. Davis, Jr.; Bernard J. Lacomis

[57] ABSTRACT

An arrangement of controls for a vapor compression open cycle industrial process heat pump permits the level of liquid and fluid pressure in a flash tank to be simultaneously and independently monitored and regulated to assure efficient operation of the system and to prevent equipment failure. Liquid level sensing means send a signal to a modulatable valve associated with a liquid discharge pump to maintain the liquid in the flash tank at an optimum level. At the same time, fluid pressure sensing means send a signal to a modulatable inlet throttle valve to regulate fluid pressure in the tank by regulating fluid as required, to maintain tank fluid pressure at the desired level.

13 Claims, 1 Drawing Figure

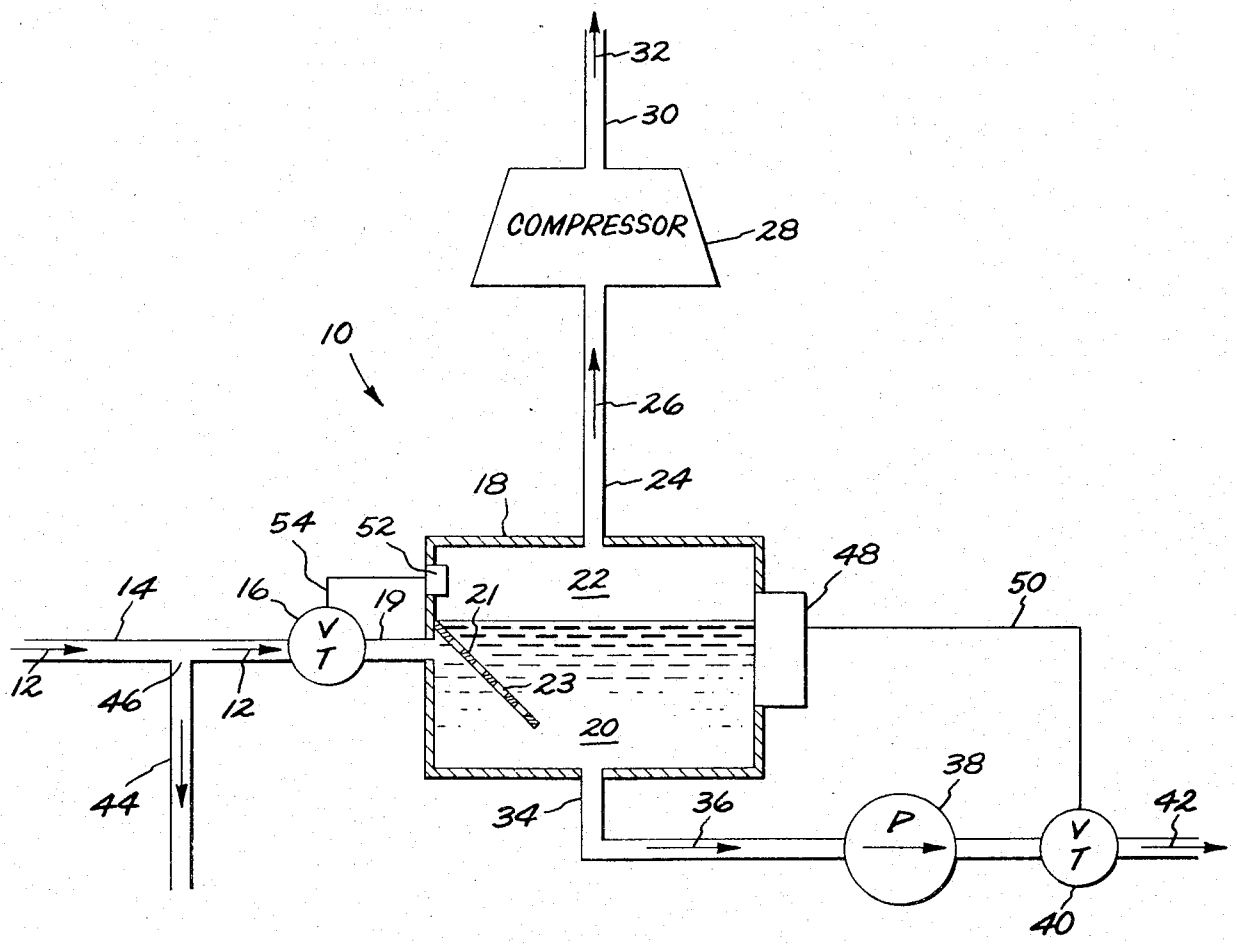
COMPRESSOR
P
V
T
10
12
14
16
18
19
20
21
22
23
24
26
28
30
32
34
36
38
40
42
44
46
48
50
52
54

FLOW CONTROL AT FLASH TANK OF OPEN CYCLE VAPOR COMPRESSION HEAT PUMPS

BACKGROUND OF THE INVENTION

The present invention relates generally to open cycle vapor compression heat pumps and, in particular, to the simultaneous and independent control of liquid level and vapor pressure in the flash tank of an industrial process heat pump.

An open cycle vapor compression heat pump useful for economically recovering heat content of a liquid typically utilizes as an input thereto a waste liquid warmed by processes or sources such as condensers cooling towers and compressor cooling which produce fluctuations in the flow rate and in the temperature of this liquid. As a result, the liquid level and fluid pressure in the flash tank portion of the heat pump are also subject to variation. Unless the liquid in the tank is maintained at an appropriate level for the tank, damage to other components in the heat pump system is likely to occur. For example, if the fluctuations in the flow rate of the warm liquid entering the system cause a large amount of liquid to enter the tank, the liquid will fill the tank and enter the compressor, resulting in compressor failure. Conversely, if little or no warm liquid enters the heat pump, the flask tank liquid level will drop below the acceptable level, or, depending on the fluctuations in flow rate of the entering liquid, the tank may empty completely. In this case vapor from the tank will enter the discharge pump, causing it to cavitate and eventually to fail. Failure of either the compressor or the discharge pump renders the entire system inoperable and is likely to require replacement of these potentially costly components.

However, not only must the flask tank liquid level be kept at an appropriate level to prevent the problems just discussed, but the tank fluid pressure must also be maintained at the design level for the heat pump to assure efficient functioning of the system compressor. If the fluid pressure in the flash tank is not monitored and regulated so that it is maintained at the design level, the compressor discharge pressure will be affected.

For a typical compressor such as a centrifugal compressor which is operated at a constant speed, the ratio of the outlet pressure to the inlet pressure is relatively constant. Thus the pressure to which the vapor from the flash tank is elevated by the compressor will decrease as the inlet vapor pressure decreases causing a loss in steam quality at the output of the compressor. Further, the thermal efficiency of the compressor is proportional to $T_H/(T_H-T_L)$ where $T_H$ and $T_L$ are the saturation temperatures at the outlet and inlet, respectively, of the compressor. Since the warm liquid at the input of the flash tank is flashed as it enters the tank, the liquid and vapor contained therein are saturated. Thus if the pressure of vapor in the flash tank decreases, its temperature will also decrease causing an undesirable decrease in thermal efficiency of the compressor. In addition, compressor power requirements are affected by the tank fluid pressure because of the interrelationship of tank fluid pressure and density of the vapor at the compressor inlet. For example, excessive inlet vapor density due to tank fluid pressure in excess of the design pressure will cause increased power demands on the compressor. If, as would be the situation when the tank fluid pressure is not controlled, compressor power in excess of the design rating is continually required, compressor failure will eventually result.

Efforts to control only the level of liquid in the tank, while helpful in averting compressor and discharge pump failures, have not achieved the efficiency of operation desired. Consequently, the level of the liquid and pressure of the fluid in an open cycle vapor compression heat pump must be carefully controlled simultaneously to assure efficient operation of the heat pump system and to avoid failure of the heat pump components. There is a need, moreover, for an arrangement of controls for an open cycle vapor compression heat pump which simultaneously and independently monitors and regulates both the level of liquid and the pressure within the system flash tank so that the heat pump functions at optimal efficiency and is not likely to be subject to costly equipment failures.

It is, therefore, an object of the present invention to control simultaneously and independently both the level of liquid and fluid pressure in a heat pump flash tank to achieve efficient operation of the heat pump and to prevent failure of the compressor and/or discharge pump.

It is another object of the present invention to provide in an open cycle vapor compression heat pump to regulate the level of liquid in the flash tank and to maintain tank pressure at the design level.

It is a further object of the present invention to provide an open cycle vapor compression heat pump having an inlet throttle valve which operates in response to fluid pressure in the flash tank and a pump discharge throttle valve which operates simultaneously with and independently from the inlet throttle valve in response to the level of liquid in the flash tank.

SUMMARY OF THE INVENTION

In accordance with the aforesaid objects there is provided in a heat pump of the open cycle vapor compression type, liquid level responsive control means and fluid pressure responsive control means which act simultaneously and independently to, respectively, maintain liquid in the flash tank at an appropriate level and maintain tank pressure at the design level. The liquid level responsive control means includes liquid level sensing means mounted in association with the flash tank and connected to a pump discharge throttle valve so that the valve is activated by the level of liquid in the tank. The fluid pressure responsive control means includes fluid pressure sensing means positioned in the flash tank and which is connected to and activates an inlet throttle valve in response to fluid pressure inside the flash tank. The fluid pressure responsive control means preferable comprises a pressure transducer positioned within the flash tank which signals the inlet throttle valve to close if the tank fluid pressure exceeds the design level or to open if the tank fluid pressure falls too low.

The features of the invention believed to be novel are set forth with particularity in the appended claims. The invention itself, however, both as to organization and method of operation, together with further objects and advantages thereof, may best be understood by reference to the detailed description taken in connection with the accompanying drawing.

BRIEF DESCRIPTION OF THE DRAWING

The single FIGURE, is a schematic representation of an open cycle vapor compression heat pump showing the liquid level responsive control means and the fluid pressure responsive control means of the present invention.

BEST MODE FOR CARRYING OUT THE INVENTION

The type of heat pump in which the present invention is most effectively employed is an open cycle vapor compression heat pump having a continuous supply of relatively warm liquid such as is produced by a process which causes the flow rate and temperature of this fluid to fluctuate. These fluctuations of the entering fluid ultimately will interfere with efficient compressor operation if their effects on the fluid in the system flash tank are not correctly modulated. The vapor compression open cycle heat pump shown schematically in the FIGURE includes an arrangement of controls which function simultaneously and independently to modulate the effects on the fluid in the system flash tank caused by fluctuations in flow rate and temperature of liquid entering the system.

In the heat pump system 10, warm waste liquid, such as, for example, that discharged during operation of a turbine or cooling tower (not shown), enters the system as shown by arrows 12 through conduit 14. Conduit 14 includes positioned therein a throttle valve 16 through which the warm liquid must flow to enter a flash tank 18. Throttle 16 may be used as a flash throttle in which case the warm liquid 19 enters flash tank 18 as a saturated two phase (liquid and vapor) fluid and strikes baffle 21 having a plurality of orifices 23 therethrough. Baffle 21 prevents droplets of liquid from entering compressor 28. Warm liquid 20, fills a portion of flash tank 18. The remainder of flash tank 18 is occupied by a gaseous layer 22 which is primarily the vapor phase of liquid 19. This gas or vapor 22 flows from flash tank 18 through conduit 24 along the path shown by arrow 26 into a compressor 28 where it is compressed to produce steam, which exits compressor 28 into conduit 30 along the path shown by arrow 32. The hot steam thus produced is available for utilization by conventional heat exchange or like apparatus (not shown).

Liquid 20, which is no longer at the same temperature as the entering liquid 19 due to the extraction of energy required to form vapor 22, is pumped from flash tank 18 by a discharge pump 38 through conduit 34 along the path shown by arrow 36. Discharge pump 38 pumps liquid to a throttle valve 40 wherein discharge of cool liquid, represented by arrow 42, may be controlled. It is necessary to provide throttle valve 40 at the output of pump 38. Since liquid 20 entering conduit 34 is saturated, any reduction of the pressure, such as is caused by throttling a liquid, of liquid 20 will cause a reduction in temperature of liquid 20 and a corresponding generation of two phases (liquid and vapor). A two phase input to pump 38 will cause cavitation thereof and eventual failure of the pump.

The system may further include bypass flow passage 44 which joins conduit 14 upstream of inlet throttle valve 16 at junction 46. Some of the warm liquid produced by the process which supplies the subject heat pump may thereby be diverted from entering the heat pump and used for other purposes.

Maintenance of the liquid 20 within flash tank 18 at the proper level is required to prevent component failure during operation of the present heat pump system. Specifically, the level of liquid 20 must be controlled to assure that liquid does not fill the tank and flow through conduit 24 into compressor 28, which would cause the compressor to fail. Further, the level of liquid 20 must not be permitted to drop to the point where vapor 22 can flow through conduit 34 into discharge pump 38, causing the pump to fail. The present invention concerns apparatus for maintaining liquid 20 at a level which prevents either of the events just described from occurring.

A liquid level sensor 48 is mounted on flash tank 18 to respond to changes in the level of liquid 20. Liquid level sensor 48 transmits a signal or feedback along a line 50 to discharge pump throttle valve 40 which causes the valve to open or close, as required by the level of liquid 20 sensed by sensor 48. Alternatively, pump throttle valve 40 is preferably continuously variable from a fully open position to a fully closed position being controlled by the amplitude or value coded into the feedback signal from liquid level sensor 48. If the level of liquid 20 in tank 18 is above the optimum level that is, that level which would permit at least some of liquid 20 to enter compressor 28, level sensor 48 signals valve 40 to open so that liquid 20 will be pumped from tank 18 through conduit 34 and discharged. If the level of liquid 20 in tank 18 is sensed to be below the optimum level, that is, below the level which would permit at least some of vapor 22 to enter pump 38, feedback from level sensor 48 will cause valve 40 to close, thus preventing the discharge of liquid 20 from the tank 18 until the level of liquid 20 exceeds the optimum level for the system. The level of liquid 20 in tank 18 is thereby monitored and regulated by liquid level sensor 48 and pump discharge valve 40. Thus the optimum level will typically encompass an acceptable range of levels which range is dependent on configuration and orientation of tank 18.

In a vapor compression open cycle heat pump, maintenance of fluid pressure in tank 18 at the design level for the system is essential for efficient compressor operation as hereinbefore described. Providing a liquid level control alone is not sufficient to maintain required pressure within tank 18 because of fluctuations in fluid flow rate and temperature of warm liquid entering the heat pump through conduit 14. Consequently, a control mechanism which functions independently of the liquid level control system is required. However, simultaneous control of tank pressure is also required because of the effect the amount of liquid in the tank will have on the fluid pressure. Maintenance of optimum fluid pressure is achieved in the preferred embodiment by providing a fluid pressure sensor 52, positioned within flash tank 18 responsive to pressure in tank 18. Fluid pressure sensor 52 preferably comprises a pressure transducer connected to inlet throttle valve 16 by a line 54 which communicates signals from the pressure transducer to the valve. Inlet throttle valve 16 opens in response to a signal from transducer 52 indicating that tank pressure is too low, which allows more warm liquid to enter flash tank 18 to increase the pressure therein. Conversely, transducer 52 signals valve 16 to close if pressure inside tank 18 exceeds the design level, which is determined by the pressure ratio of the compressor output to the compressor input required to produce steam efficiently as hereinbefore described, so that warm liquid will be prevented from entering flash tank 18. Alternatively, inlet throttle valve 16 is preferably continuously variable from a fully open position to a fully closed position being controlled by the amplitude or value coded into the feedback signal from fluid pressure sensor 52.

The two sets of controls provided by the present invention function simultaneously and independently of each other to insure that, at all times, the tank pressure and liquid level are maintained at their optimum levels for the heat pump system. Moreover, this constancy is achieved when the flow rate and temperature of the warm liquid entering the inlet throttle valve, both of which influence liquid level and tank pressure, are not constant, but are subject to fluctuation.

The present invention is particularly suited for application in an industrial process heat pump of the vapor compression open cycle type wherein the entering fluid is obtained from a source which imparts fluctuations in flow rate and temperature to this fluid which must be modulated to achieve the efficient operation of the system and to prevent component failure.

Thus has been described and illustrated a means and method for simultaneously and independently controlling both the level of liquid and fluid pressure in a heat pump flash tank and for maintaining them at a predetermined value. Further, in a preferred embodiment, an inlet throttle valve which operates in response to fluid pressure in the flash tank and a pump discharge throttle valve which operates simultaneously with and independently from the inlet throttle valve in response to the level of liquid in the flash tank has been illustrated and described.

While only certain preferred features of the invention have been shown by way of illustration, many modifications and changes will occur to those skilled in the art. It is to be understood that the appended claims are intended to cover all such modifications and changes as fall within the true spirit and scope of the invention.

What is claimed is:

1. A vapor compression open cycle heat pump having a source of fluid supplied thereto, said fluid exhibiting fluctuations in its temperature and in its rate of entry into said heat pump including inlet valve means for regulating fluid flow into said heat pump from said source of fluid; tank means connecting to said inlet valve means for holding and separating said fluid into a liquid portion and a vapor portion; a compressor fluid dynamically communicating with said tank means such that the vapor portion of said fluid can flow to said compressor; a discharge pump fluid dynamically communicating with said tank means such that the liquid portion of said fluid can flow to said discharge pump; discharge valve means fluid dynamically communicating with said discharge pump so as to regulate the flow of fluid from said pump; liquid level responsive control means associated with said tank means for monitoring and controlling the amount of liquid in the liquid portion of said fluid; and fluid pressure responsive control means mounted within said tank means for monitoring and controlling pressure of the vapor portion of said fluid.

2. The vapor compression open cycle heat pump of claim 1, wherein said liquid level responsive control means includes liquid level sensing means for precisely determining the level within said tank means of the liquid portion of said fluid, and discharge valve signalling means for controlling said discharge valve means in response to the level of the liquid in said tank means.

3. The vapor compression open cycle heat pump of claim 2, wherein said fluid pressure responsive control means includes fluid pressure sensing means for precisely determining the pressure of the vapor portion of said fluid within said tank means, and inlet valve signalling means for controlling said inlet valve means in response to pressure of the vapor in said tank means.

4. The vapor compression open cycle heat pump of claim 3, wherein said inlet valve means comprises a modulatable throttle valve responsive to feedback from said fluid pressure sensing means.

5. The vapor compression open cycle heat pump of claim 2, wherein said discharge valve means comprises a modulatable throttle valve responsive to feedback from said lliquid level sensing means.

6. A method for simultaneously controlling the pressure and liquid level of a flash tank containing a liquid and a vapor phase of a liquid feedstock while removing at least a portion of said vapor phase of said liquid feedstock from said tank comprising:

sensing pressure of vapor within said flash tank;

regulating introduction of liquid feedstock into said flash tank in response to the pressure of vapor within said flash tank;

sensing level of liquid within said flash tank; and regulating withdrawal of liquid from said flash tank in response to the level of liquid within said flash tank.

7. The method of claim 6, wherein regulating introduction of liquid feedstock into said flash tank includes:

(a) preventing liquid feedstock from entering said flash tank when said pressure of vapor is above a first predetermined value; and (b) injecting said liquid feedstock into said flash tank when said pressure of vapor is below a second predetermined value.

8. The method as in claim 7, wherein said first predetermined value is equal to said second predetermined value.

9. The method of claim 6 wherein regulating withdrawal of liquid from said flash tank includes:

(a) preventing liquid from leaving said flash tank when said level of liquid is below a first predetermined value; and (b) withdrawing liquid from said flash tank when said level of liquid is above a second predetermined value.

10. The method of claim 9 wherein said first predetermined value is equal to said second predetermined value.

11. A vapor compression open cycle heat pump, comprising:

tank means for holding and separating a fluid into a liquid portion and a vapor portion;

inlet valve means coupled to said tank means for controlling input of said fluid into said tank means;

inlet valve signalling means coupled to said tank means for controlling said inlet valve means in response to pressure within said tank means;

a discharge pump fluid dynamically communicating with said tank means such that the liquid portion of said fluid can flow to said discharge pump;

discharge valve means coupled to said discharge pump for regulating flow of liquid from said pump; and discharge valve signalling means coupled to said tank means for controlling said discharge valve means in response to level of liquid in said tank means.

12. The heat pump as in claim 11, further comprising compressor means fluid dynamically communicating with said tank means such that at least some of the vapor portion of said fluid can flow to said compressor means.

13. The heat pump as in claim 12, further comprising baffle means coupled to said tank means for preventing said liquid portion of said fluid from entering said compressor means.

* * * * *